United States Patent [19]

Reinhold

[11] Patent Number: 4,492,563

[45] Date of Patent: Jan. 8, 1985

[54] BURNER FOR HEATING AIR AND DISPOSED IN A PASSAGE THROUGH WHICH AIR FLOWS

[75] Inventor: Klaus Reinhold, Lengerich, Fed. Rep. of Germany

[73] Assignee: Windmoller & Holscher, Lengerich, Fed. Rep. of Germany

[21] Appl. No.: 487,466

[22] Filed: Apr. 22, 1983

[30] Foreign Application Priority Data

Apr. 22, 1982 [DE] Fed. Rep. of Germany ..... 3214923

[51] Int. Cl.[3] ..... F23Q 3/00

[52] U.S. Cl. ..... 431/264; 431/201; 431/352; 432/222; 239/558

[58] Field of Search ..... 431/198, 201, 264, 265, 431/285, 350, 352; 432/222; 239/556–558

[56] References Cited

U.S. PATENT DOCUMENTS 3,511,589 5/1970 Rothhaar et al. ..... 431/350

FOREIGN PATENT DOCUMENTS 1444673 8/1975 United Kingdom ..... 431/352

866338 9/1981 U.S.S.R. ..... 431/350

*Primary Examiner*—Margaret A. Focarino

*Attorney, Agent, or Firm*—Fleit, Jacobson, Cohn & Price

[57] ABSTRACT

A burner for heating air flowing in a passage in which the burner is disposed comprises a tube connected to the gas supply. The tube has mixing plates with flow apertures for the air secured to it to diverge from each other conically in the direction of air flow and is provided with gas outlet apertures between the mixing plates. The burner also comprises ignition means for the gas. The tube is in the form of a circular annulus and has gas outlet apertures in circumferential directions. The mixing plates consist of an outer conically diverging and an inner conically converging annular plate, the plates being at least partially bounded over their axial length by an air guide plate which converges conically in the direction of air flow and which is secured to the wall of the air passage for axial displacement. The ignition means are disposed in front of the gas outlet apertures which are arranged on a circle or a plurality of concentric circles.

4 Claims, 5 Drawing Figures

BURNER FOR HEATING AIR AND DISPOSED IN A PASSAGE THROUGH WHICH AIR FLOWS

BACKGROUND OF THE INVENTION

The invention relates to a burner for heating air according to the classifying portion of claim 1.

According to known burners of this kind, the tubes provided with gas outlet apertures consist of straight tube lengths to which the possibly corrugated conically diverging mixing plates are secured, the V-shaped gaps at the ends being closed by end plates, one of which is provided with the ignition electrode. Beyond the mixing plates, the air passage contains manually adjustable air guide plates by which the quantity of fresh air passing through the mixing plates can be controlled.

With an adequately large parallel air flow, the known burners work well at an elevated output, i.e. at elevated temperatures. However, if less gas is introduced to reduce the power of temperature, the gas burns only on the gas supply side of the tube, where the ignition electrode is also disposed. One therefore encounters the disadvantage of a non-uniform temperature gradient for incomplete combustion of the gas. One-sided combustion of the gas is aggravated if the tubes provided with the gas outlet apertures and the mixing plates are assembled to form L, T or H-shaped burners because it will be difficult for the flames to jump over the corners formed by the burner. As a result, one obtains non-uniform discontinuous flame configurations which prevent optimum combustion.

SUMMARY OF THE INVENTION

It is therefore the problem of the invention to provide a burner of the aforementioned kind which facilitates uniform combustion of the gas over its length even with a reduced gas supply.

According to the invention, this problem is solved by the features in the characterising portion of claim 1. By reason of its annular construction, the burner of the invention can be so disposed in the passage through which the air flows that one obtains uniform flow profiles which enhance combustion. The amount of air flowing through the mixing plates can be simply controlled by the axially displaceable conical air guide plate. The amount of air flowing through the outer annular mixing plate depends on the size of the annular gap between the rim of this annular mixing plate and the air guide plate, which can be varied in the desirable manner by displacing the air guide plate.

In a particularly advantageous embodiment, the tube has at least two concentric passages which are separated by intermediate walls in the zone of the gas supply and are provided on the side of the first dividing wall opposite to the gas supply with a gas overflow conduit connecting the passages. This series connection of concentric annular passages is achieved in that the following passage is traversed by gas only after the first passage has been completely filled with gas. Since an adequate amount of gas flows out of the gas outlet apertures of the first passage even during operation on partial load, one obtains a uniform annular flame which ensures complete combustion and a uniform temperature characteristic. For higher outputs, the gas that has not already passed through the gas outlet apertures of the first annular passage will flow into the subsequent annular passage or passages so that higher air temperatures can be achieved without any substantial change to the temperature profile. The gas leaving the annular passage following the first annular passage increases the total amount of combustible gas, complete combustion of the gas being ensured by the annular flame produced by the first passage. Instead of a single annular tube sub-divided into concentric annular passages by one or more circumferential dividing walls, one can also provide two or more concentric tubes.

Other advantageous embodiments of the invention have been described in the subsidiary claims.

BRIEF DESCRIPTION OF THE DRAWINGS

One example of the invention will now be described in more detail with reference to the drawing, wherein.

DESCRIPTION OF THE PREFERRED EMBODIMENTS

Figure 3:
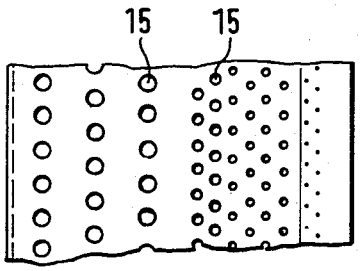
FIG. 3 is a plan view of part of the mixing plates.

By means of retaining members (not shown), the annular burner 2 is secured in the tube 1 with its axis coinciding with the tube axis, the tube carrying the air to be heated. The burner 2 consists of an annular tube sub-divided in its medial plane by two dished members 3, 4. The dished members 3, 4 have their rims superposed and are screw-connected to each other by flange-like extensions 5, 6. The dished members 3, 4 are provided with circumferentially extending central webs 7, 8 which sub-divide the burner tube into concentric passages 9, 10. At both sides of the web 7, the tube dish or shell 4 is provided with gas outlet apertures 11, 12 arranged on concentric circles. The nozzle orifices formed by the gas outlet apertures 11, 12 open at the end of an annular web which is connected to the tube shell 4 and to the cylindrical inner and outer sides of which the funnel-shaped mixing plates 13, 14 are secured. As shown in FIG. 3, the mixing plates 13, 14 are provided with apertures 15 of different size for the passage of air.

Figure 2:
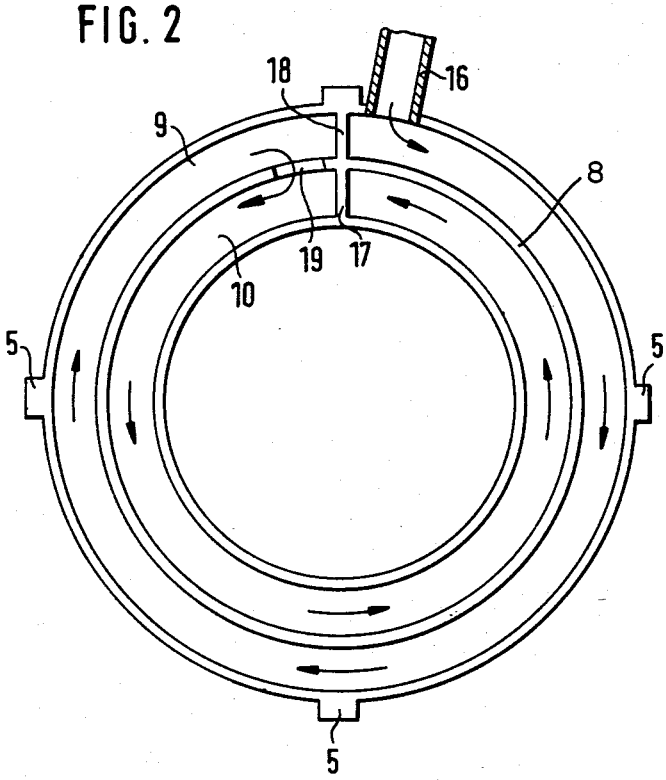
FIG. 2 is a plan view of one half of the annular burner tube
Figure 5:
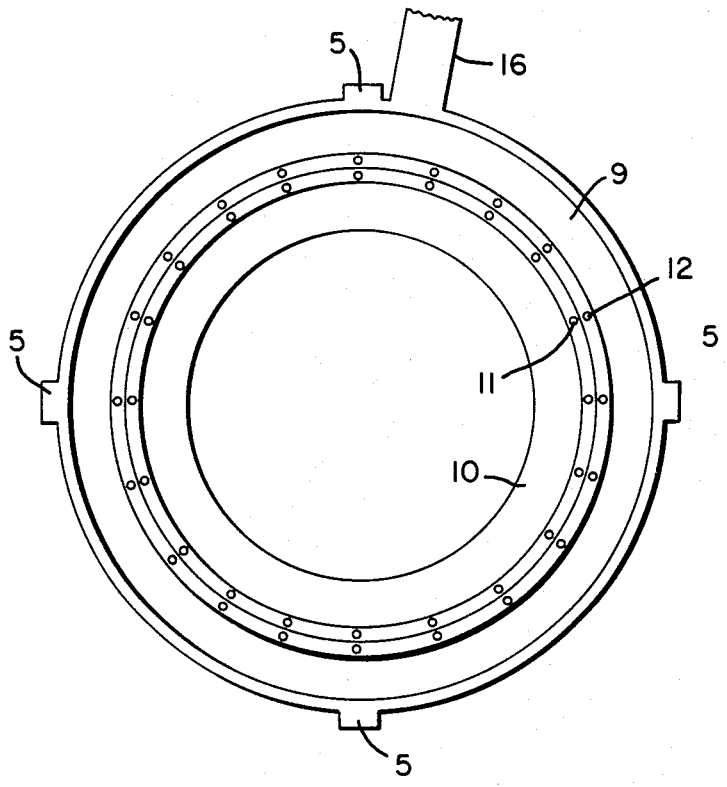
FIG. 5 is an elevational view of the burner looking upstream and showing the arrangement of the gas discharge apertures.

FIG. 2 shows that the passages 9, 10 at the left-hand side of the connecting nipple 16 for the gas are provided with transverse walls 17, 18. At the left adjacent to the transverse walls 17, 18, the passages 9, 10 are interconnected by an aperture 19. The gas supplied through the tube nipple 16 thus first flows in the direction of the arrows through the outer passage 9 and will enter the inner passage through the apertures 19 only if, during its flow through the outer passage 9, it has not left through the nozzle orifices 12 connected thereto. As shown in FIG. 5, the cross-sections of the outlet apertures in the passage 9 that is directly connected to the connecting nipple 16 of the gas supply are smaller than the cross-sections of the outlet apertures in the passage 10 concentric therewith.

Figure 1:
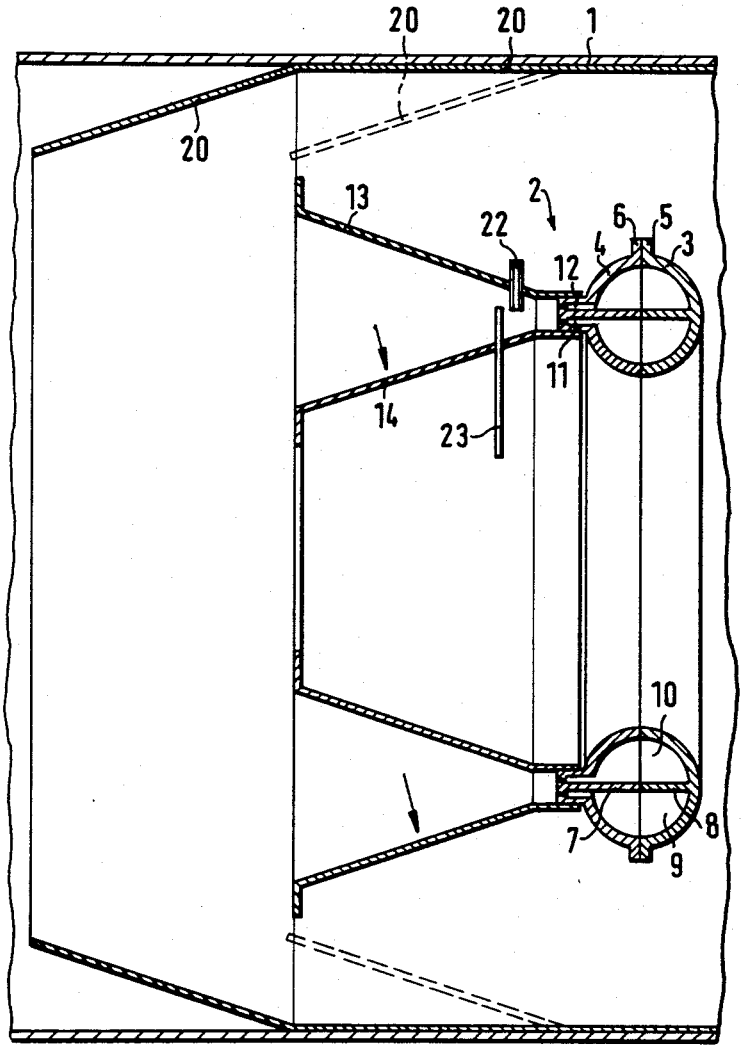
FIG. 1 is an axial section in the region of the annular burner through the tube bounding an air passage.

To control the air flowing through the outer mixing plate 13, there is a guide plate 20 which conically converges in the direction of flow and which is guided for axial displacement on the inner wall of the tube 1. The guide plate 20 is shown in full lines in a projected position in which a relatively large annular gap exists between it and the outer rim of the outer mixing plate 13 so that the major amount of air can flow past the outside of the outer mixing plate 13 without passage through the holes therein. In broken lines in FIG. 1, the guide plate 20 is shown in a retracted position in which only a relatively narrow annular gap is provided between it and the outer rim of the mixing plate 13, so that a larger amount of the supplied air flows through the mixing plates.

The ignition gas tube 22 is arranged in the outer mixing plate 13 in front of the nozzle orifices 11, 12 that are disposed on concentric circles. For the purpose of ionisation monitoring, the sensor 23 is provided in the inner mixing plate 14.

Figure 4:
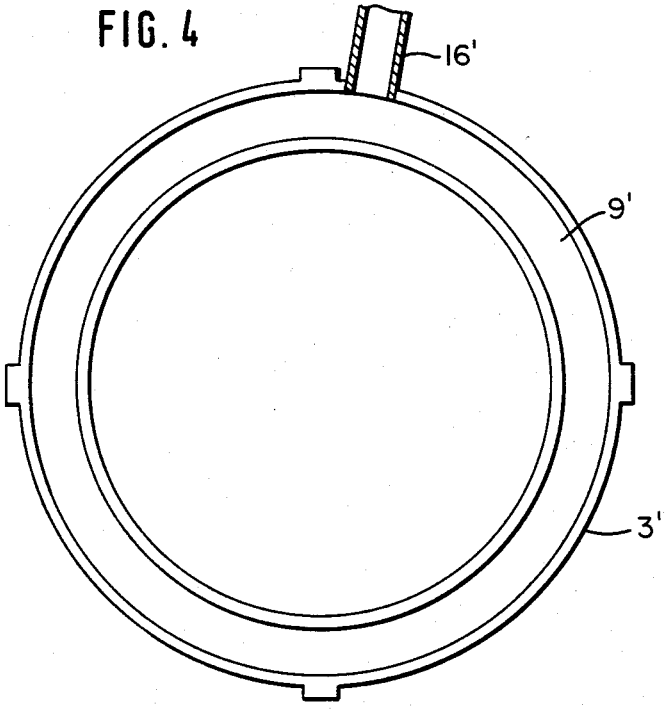
FIG. 4 is a plan view of one-half of a burner tube having an annular passage.

In the embodiment shown in FIG. 4, the burner tube comprises two dish—shaped halves (only one of which, half 3', is shown) bounding only one annular passage 9', into which the connecting nipple 16' opens, and the gas outlet apertures are on the other dish-shaped half, which is not shown.

I claim:

1. A burner for heating air and disposed in a passage through which the air flows, comprising: a tube which is connected to a gas supply and having mixing plates with flow apertures for the air, the mixing plates secured to the tube to diverge from each other conically in the direction of air flow, the tube being provided with gas outlet apertures between the mixing plates and having the form of a circular annulus in which the gas outlet apertures are disposed in a circular array, the mixing plates including an outer conically diverging plate and an inner conically converging plate which are at least partially bounded over their axial length by an air guide plate which converges conically in the direction of air flow and which is carried on an inner surface of the air passage for axial displacement, and ignition means disposed downstream of the gas outlet apertures.

2. A burner according to claim 1, wherein the tube has at least two concentric annular passages which each include a transverse wall in the zone of the gas supply connection and are provided on the side of the transverse walls opposite to the side having the gas supply connection with a connecting means for connecting the passages.

3. A burner according to claim 2, wherein the concentric passages are formed by an annular tube which is sub-divided by a circumferential dividing wall and wherein the connecting means connecting the passages is defined by an aperture in the dividing wall.

4. A burner according to claim 2, wherein the cross-sections of the outlet apertures in the passage directly connected to the gas supply (16) are smaller than the cross-sections of the outlet apertures in the passage concentric therewith.

* * * * *